US005782350A

United States Patent [19]

Weisburn et al.

[11] Patent Number: 5,782,350

[45] Date of Patent: Jul. 21, 1998

[54] MAGNETIC LOCKING MECHANISM FOR A SECURITY PACKAGE

[75] Inventors: James T. Weisburn, Massillon; Matthew Perry Williams, North Canton, both of Ohio

[73] Assignee: Alpha Enterprises, Inc., North Canton, Ohio

[21] Appl. No.: 857,964

[22] Filed: May 16, 1997

Related U.S. Application Data

[60] Provisional application No. 60/038,629 Feb. 19, 1997.

[51] Int. Cl.[6] ..... B65D 55/02; B65D 85/57

[52] U.S. Cl. ..... 206/308.2; 206/1.5; 206/807; 70/63

[58] Field of Search ..... 206/1.5, 308.2, 206/387.11, 807, 818; 70/63

[56] References Cited

U.S. PATENT DOCUMENTS

| | | | |
|---|---|---|---|
| 767,298 | 8/1904 | Louis . | |
| 971,423 | 9/1910 | Walters . | |
| 3,933,240 | 1/1976 | Humble | 206/1.5 |
| 4,466,540 | 8/1984 | Lotrous et al. | 206/1.5 |
| 4,727,984 | 3/1988 | Bennardo | 206/1.5 |
| 4,966,020 | 10/1990 | Fotheringham et al. | 70/276 |
| 5,031,756 | 7/1991 | Buzzard et al. | 206/308.2 |
| 5,147,034 | 9/1992 | Broadhead et al. | 206/1.5 |
| 5,209,086 | 5/1993 | Bruhwiler | 70/57.1 |
| 5,211,283 | 5/1993 | Weisburn et al. | 206/1.5 |
| 5,289,914 | 3/1994 | Holmgren | 206/1.5 |
| 5,390,515 | 2/1995 | Essick | 70/63 |
| 5,524,752 | 6/1996 | Mazzucchelli | 206/1.5 |
| 5,588,315 | 12/1996 | Holmgren | 70/57.1 |
| 5,598,728 | 2/1997 | Lax | 70/276 |

*Primary Examiner*—Jimmy G. Foster
*Attorney, Agent, or Firm*—Sand & Sebolt

[57] ABSTRACT

A reusable plastic package for securely holding and displaying a rectangular article such as a compact disc. This reusable plastic package includes a housing having large and small compartments formed on opposite ends for selectively storing an article in the larger of the compartments. The large compartment has an access opening for inserting and removing the article into and out of the compartment. The small compartment functions as a lock compartment whereby a slide plate is slidably mounted thereon and selectively movable across a portion of the access opening of the larger storage compartment for releasably securing the article in the larger storage compartment. Magnetically releasable locking levers are formed within the lock compartment and interengage with mating projections formed on the slide plate when the slide plate is in a selected locked position for securing the article within the package due to a portion of the slide plate blocking the access opening. A magnetic key disengages the locking levers from the projections to enable the slide plate to be moved to the unlocked position. The locking levers and projections are spaced apart in groups in the locking compartment and on the slide plate to provide space for an electronic article surveillance tag.

20 Claims, 4 Drawing Sheets

MAGNETIC LOCKING MECHANISM FOR A SECURITY PACKAGE

CROSS-REFERENCE TO RELATED APPLICATION

This application claims the benefit of U. S. Provisional Application Ser. No. 00/038,629, filed Feb. 19, 1997.

BACKGROUND OF THE INVENTION

1. Technical Field

The invention relates to security packages and in particular to a security package for securely holding and displaying a rectangular-shaped article such as a storage box for recorded media. Specifically, the invention relates to a reusable security package for holding and displaying recorded media and its storage container such as compact discs within jewel boxes, having a magnetic lock which when in a locked position prevents unauthorized removal of the article from within the security package.

2. Background Information

In recent years, recorded media such as audio cassettes, compact discs, digital audio tapes, and mini discs (MD) have become increasingly popular, almost entirely replacing record discs and 8-track audio tapes. Specifically, compact discs (CDs) are growing most rapidly in popularity with rapidly increasing sales of compact disc players. These compact discs are thin flexible plastic resin sheets with a digitally recorded engraved pattern and resemble small vinyl photograph records and are operated by a laser enclosed in a compact disc player. Since the compact discs are relatively small, very thin, and are usually far more expensive than the heretofore used audio tapes and 8-track tapes, CDs are more susceptible to theft when displayed for sale in a retail store outlet.

The introduction of these recorded media into the marketplace presents a problem to the retailer sellers in that these recorded media are considerably smaller than the heretofore used record discs and 8-track tapes, but still have to be displayed so that prospective purchasers can inspect the same to determine the artist, songs, etc. on the recorded media. This presents a security problem due to the extremely small size of the recorded media.

Therefore, it has become important that the recorded media, which are usually contained within their own storage container or box, such as a jewel box for compact discs, be repackaged in an outer security package to prevent their theft from the display cases used in most retail businesses. Since the compact discs generally are retained within a plastic box commonly referred to as a "jewel box" to protect the disc from scratching and damage and to provide a protective storage container for the disc when not in use, it is desirable that these plastic storage boxes be retained in the larger package for display to prevent theft of the smaller plastic storage box containing the CD. Various types of housings and security packages have been developed to provide a safe and secure device for displaying the CDs within jewel boxes while retarding unauthorized removal of the CD from the display package and subsequent theft from the store. Various prior art display and security containers are shown in U.S. Pat. Nos. 3,871,516, 4,285,429, 4,381,836, 4,589,549, 4,759,442, 4,760,914, 4,805,769, 4,834,238, 4,881,645, 4,951,814, 5,205,401, 5,211,283, and 5,460,266.

Although these prior art security packages for the various types of cassettes and recorded media have proven satisfactory for many applications, they present various problems, that is, the prior art security devices are bulky, complicated, difficult and time consuming to use or lock/unlock, too thick in relation to the cases that house the cassettes or CDs, not secure enough when locked, expensive and/or time consuming to manufacture. Also, most of these prior art security packages require a manually operated key having a plurality of tangs for releasing the locking mechanism at the retail store for removing the CD and jewel box therefrom enabling the security package to be reused by the store. Some of these keys have sharp tangs which could injure the store clerk, or flat tangs requiring a larger access opening to the lock mechanism, thereby making the security package more susceptible to unauthorized tampering.

Therefore, the need exists for an improved security package for various types of recorded media such as CDs in which the recorded media are maintained in their usual display boxes for standard display yet protected from theft. In addition, a need exists for an improved security package for various types of recorded media which is absent mechanical locks which are often difficult to use, susceptible to breakage, and bulky, and which eliminates the need to use the usual key having the outwardly projecting tangs as the unlocking mechanism.

SUMMARY OF THE INVENTION

Objectives of the invention include providing an improved security package which can be mass produced relatively inexpensively as a two-piece molded plastic member, one piece of which forms the main housing and the other piece being a lock or slide plate slidably or pivotally mounted on the housing for securing a rectangular-shaped article in a storage compartment where the improved security package is slim in depth, preferably comparable to the depth of a jewel case, inexpensive and easy to both make and use, and designed for repeated reuse, and which can be manually loaded by retail shop personnel for subsequent sale, and which can be unloaded easily at the point of sale.

Another objective of the invention is to provide such a security package in which printed information on the stored article, and specifically on the large front or back face of the jewel case, is visible through enlarged openings formed in the walls of the housing which form the storage compartments.

Another objective of the invention is to provide such a security package in which the article to be stored is slid easily into the storage compartment and secured therein by the easily operated lock plate which is selectively moved over the access opening of the storage compartment to prevent unauthorized removal of the article from within the storage compartment, and magnetically actuated to disengage to allow removal of the article.

Another objective of the invention is to provide such a security package in which an inexpensive magnetic key unlocks a magnetically actuated lock plate from the housing, whereby the lock plate can be moved to an unlocked position permitting the stored article to be manually removed from the storage compartment upon completion of a sale, enabling the package to be reused for storing another article for sale.

Another objective is to provide such a package which can be molded of rugged plastic material and repeatedly reused, thereby reducing the cost to a manufacturer and/or distributor of the articles to be stored therein, such as audio cassettes, compact discs, etc.

Another objective of the invention is to provide such a security package in which an end of the lock plate opposite of a locking edge is aligned with an end wall of a housing having a lock compartment therein when the plate is in a locked position, preventing the formation of a lip which could be grasped to enable the lock plate to be pried from the housing to steal a stored article from the package.

Another objective of the invention is to provide such a security package in which magnetic locking levers and projections are located within the lock compartment and lock plate, and are spaced apart in groups, thereby enabling another portion of the compartment to be void for the placement and storage of an electronic article surveillance tag therein, preferably in an inconspicuous manner, but in any case, to detect unauthorized removal of the security package with an article therein from the retail business.

Another objective is to provide such a security package in which the orienting tabs and grooves on the lock plate that secure the article when locked, are formed as part of the locking mechanism and prevent the locking mechanism from moving to the locked position unless the orienting tabs and grooves are received within openings and stops formed in the storage compartment to ensure that the article to be stored is properly oriented within the storage compartment of the security package.

Another objective of the invention includes providing an improved security package which enables the compact disc to remain in its usual display and storage package such as its jewel box in the case of a CD, which in turn is secured within the security package that retards theft of the compact disc.

Another objective of the invention is to provide such an improved security package which has an end portion thereof with a thickness generally equal to the thickness of the display package such as a jewel case containing the compact disc, which display package is secured within the security package, thereby enabling the security package to be mounted and displayed in display cases and racks heretofore only useable for the unsecured package, that is the jewel case, by positioning the security package in the display rack by the end of the package which has the same general shape and thickness of the jewel case contained therein.

Another objective of the invention is to provide such an improved security container which can be easily injection molded of various types of plastics in two components, namely, a housing and a lock plate, wherein the lock plate then is easily snap-fitted into position on the housing, thus providing for the economic manufacture and assemble of the security container.

Another objective of the invention is to provide such a security package which is of an extremely simple construction, which achieves the stated objectives in a simple, effective, an inexpensive manner, and which solves problems and satisfies needs in the art.

These and other objectives and advantages are obtained by the improved security package of the invention, the general nature of which may be stated as including a security package for holding and displaying a rectangular-shaped article including:

a) a housing having a rectangularly shaped storage compartment for selectively storing the article, said compartment having an access opening for inserting and removing the article into and out of said compartment;

b) a lock compartment formed adjacent the storage compartment;

c) a plate slidably or pivotally mountable on the lock compartment and selectively movable across at least a portion of the access opening of the storage compartment between locked and unlocked positions, for releasably securing said article in said storage compartment; and d) magnetically releasable lock means within one of said lock compartment and lock plate, the magnetically releasable lock means for selectively releasing the lock plate from the locked position when a magnetic field is proximate the magnetically releasable lock means.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT(S)

Figure 1:
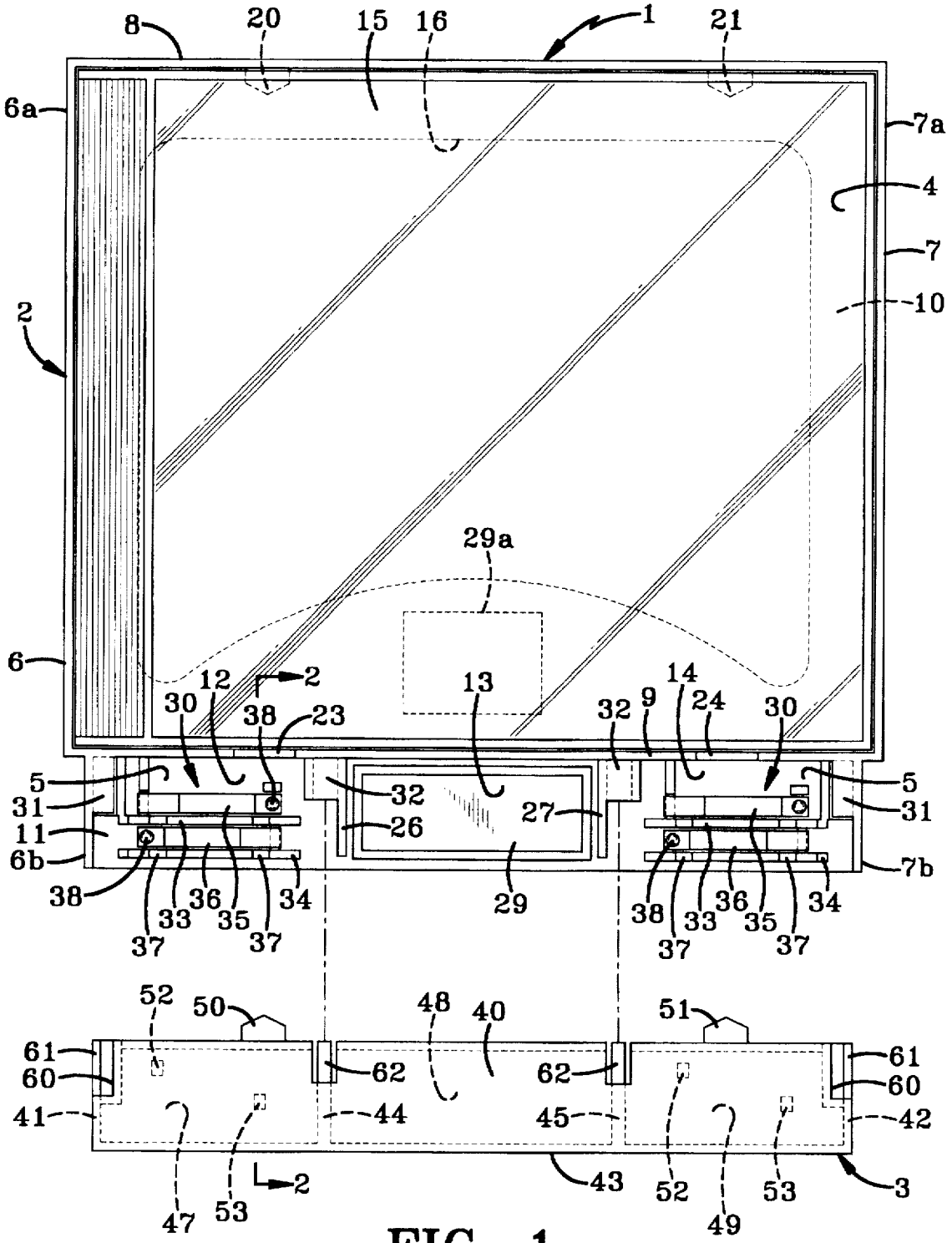
FIG. 1 is a top plan view of the security package with the locking slide plate removed therefrom.

The improved security package of the present invention is indicated generally at 1, and is shown particularly in FIG. 1. The security package 1 includes a main housing 2 and a slide or lock plate 3, where both housing 2 and slide plate 3 are each preferably formed as an integral one-piece plastic member, preferably of a high-impact polystyrene.

Security package 1 has a general rectangular configuration with a generally slim depth substantially equivalent to that of a compact disc jewel case. The generally rectangular configuration of security package 1 is defined by a large storage compartment 4 and a small lock compartment 5. Overall, housing 2 includes a pair of longitudinally extending side walls 6 and 7 of a stepped construction which extend throughout the longitudinal length of housing 2, a pair of parallel end walls 8 and 9 which extend between and are perpendicular to side walls 6 and 7, and a pair of back walls 10 and 11 (as more clearly shown in FIGS. 2–4).

Storage compartment 4 is formed by storage side wall 6a and 7a, end walls 8 and 9, and back wall 10. This resulting compartment 4 has four sides and a back face thereby providing a space in which a rectangular-shaped article 15, such as a compact disc, may be placed for storage through an open side or access opening opposite the back face which is wall 10. Wall 10 may further include one or more openings 16 preferably of smaller length and width than wall 10 and spaced inwardly apart from each of walls 6a, 7a, 8 and 9 whereby this opening 16 is provided so as to supply access to a back side of article 15 for more efficient removal of article 15 when slide plate 3 is not in the locked position as described below.

Storage compartment 4 further includes a pair of spaced apart tabs 20 and 21 extending inward from end wall 8 into storage compartment 4. Tabs 20 and 21 are preferably spaced apart from back wall 10 a distance either substantially equivalent or slightly equivalent to the depth distance of article 15, that is a depth distance of a standard compact disc jewel case when article is such. Tabs 20 and 21 may be of any geometrical configuration so long as each extends inward into storage compartment 4 so as to act as a lip for holding article 15 therein when article 15 is fully inserted within storage compartment 4, by either preferably inserting within corresponding slots in said article, or alternatively wrapping over said article. In the preferred embodiment, tabs 20 and 21 are either of a trapezoidal construction with two outermost points separated by a sloped face whereby one outermost point extends furthest into storage compartment 4, or as is shown in FIG. 1 of a semi-hexagonal shape where the hexagon is divided across the midpoint of two sides such that each tab has three outermost points extending inward into storage compartment whereby the center outermost point extends furthest therein. Storage compartment 4 also includes a pair of spaced apart notches 23 and 24 in end wall 9 where each notch extends inward from an outermost edge of end wall 9 opposite back wall 10.

Lock compartment 5 is formed by lock side walls 6b and 7b, end wall 9, and back wall 11. Lock compartment 5 is divided into three subcompartments 12, 13 and 14 by divider walls 26 and 27. Subcompartment 13 includes an electronic artificial surveillance (EAS) tag 29 (although the tag could alternatively be located in other locations such as at 29a), while subcompartments 12 and 14 include a locking mechanism 30. Subcompartments 12 and 14 each also include pry stops embodied in FIG. 1 as a planar stop 31 that is parallel to back wall 11 and spaced apart therefrom, and is integrally molded into side walls 6b and 7b, respectively. End wall 9, subcompartments 12 and 14 further include a stop 32 that is L-shaped with a parallel portion to back wall 11 that extends out from end wall 9 and divider walls 26 and 27, respectively, and is connected to a perpendicular portion to back wall 11 that extends from the parallel portion to back wall 11 and outward from end wall 9.

Each locking mechanism 30 includes a pair of access restriction walls 33 and 34 extending perpendicularly upward and spaced apart from back wall 11 as shown in FIGS. 1–4. Each of these access restriction walls 33 and 34 are spaced apart and extend transversely between one of lock side walls 6b and 7b and one of divider walls 26 and 27 within each of subcompartments 12 and 14. Each access restriction wall 33 and 34 includes a pair of cut-outs 37 for use during interaction of slide plate 3 with storage compartment 4. In accordance with the invention, each locking mechanism 30 includes a pair of metallic, resilient locking levers 35 and 36 that obliquely extend upward from back wall 11 in each subcompartment 12 and 14. In the embodiment shown in FIGS. 1–4, each pair of locking members 35 and 36 in each subcompartment 12 and 14 are spaced apart in a parallel arrangement while being fixed at opposite ends thereof. The slope of each lever 35 and 36 may be constant, or as shown in FIGS. 1, and 5–7, may include a flat region at the lever's connection end followed by an upwardly sloping region in its midsection, and terminating in a relatively flat or less sloped termination end. This change in slope may be gradual or at distinct points as is shown in the figures. Each of the levers 35 and 36 are affixed to back wall 11 by any type of fastener or fastening means 38 which could be an adhesive, rivet, or any other device and/or method of fastening.

Each of these locking levers 35 and 36 is made of a metallic material susceptible to magnetic attraction and repulsion. Each of the locking levers is bent as described above so as to have a resting or natural position where the connection end is parallel to back wall 11, while the terminating end is parallel to a similar front wall 40 in slide plate 3, with the intermediate section sloping therebetween. This resting position is clearly shown in FIG. 6 and discussed in more detail subsequent hereto. Each of these locking levers 35 and 36 is flexible so as to flex out of this position whereby the terminating end is no longer parallel to and substantially adjacent to this front wall 40; however, when the force causing such flexing is removed, each locking lever 35 and 36 is resilient and returns to the resting position.

Slide plate 3 as is shown in FIG. 1 has front wall 40 terminating at opposing sides in side walls 41 and 42 and along a bottom edge in bottom wall 43. A pair of divider walls 44 and 45 extend from front wall 40 in a spaced apart and parallel manner between side walls 41 and 42 so as to divide slide plate 3 into three subcompartments 47, 48, and 49 of similar dimension to the subcompartments 12–14 of compartment 5.

Figure 3:
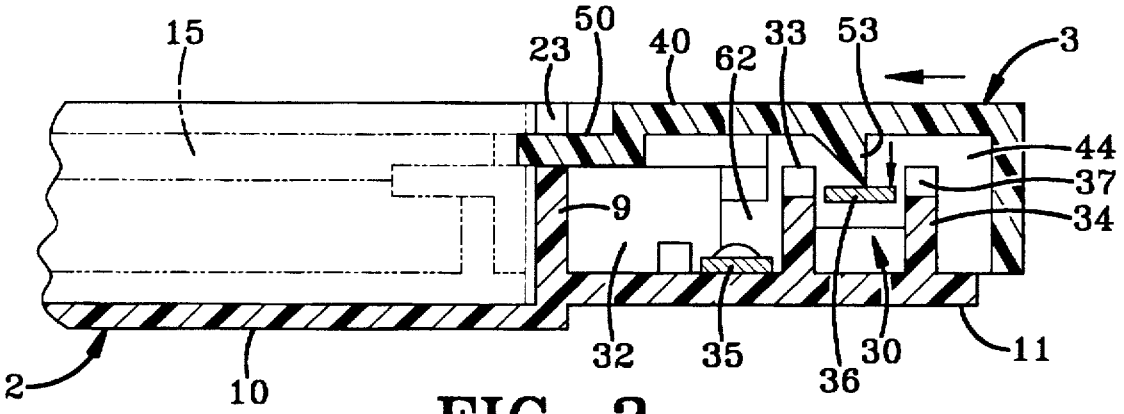
FIG. 3 is an enlarged fragmentary sectional view similar to FIG. 1 with the slide plate partially inserted into the housing but not locked.
Figure 5:
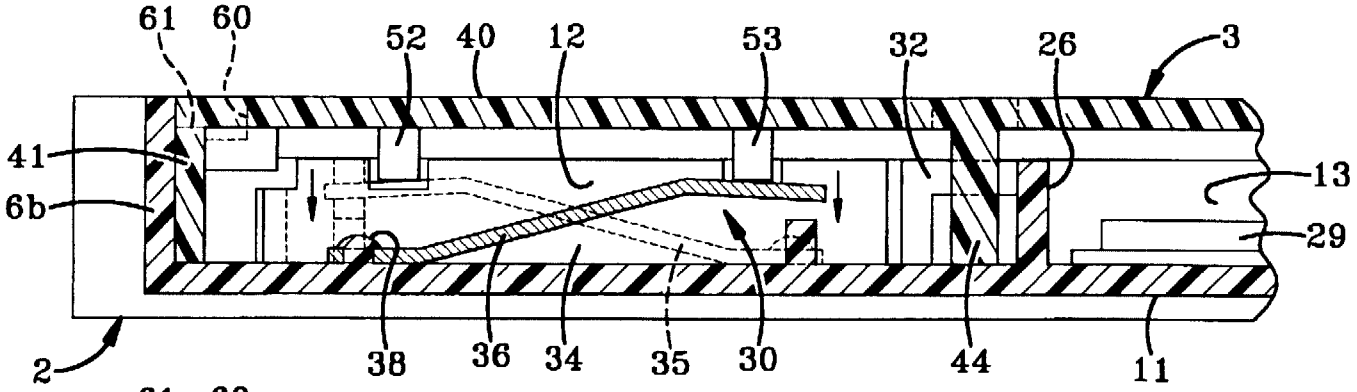
FIG. 5 is a transverse sectional view taken on line 5—5 of FIG. 2 when the slide plate is partially inserted into the housing as shown in FIG. 3.

Slide plate 3 includes a pair of tabs 50 and 51 extending substantially planarly from and outwardly of front wall 40, and in an aligned manner with notches 23 and 24, respectively, when slide plate 3 is aligned with lock compartment 5 as is shown in FIG. 1. On an inner surface of slide plate 3, locking nubs or ramps 52 and 53 extend downwardly from front wall 40 in each of subcompartments 47 and 49, respectively. In each subcompartment 47 and 49, the nubs 52 and 53 are spaced apart in a diagonal manner. This diagonal spacing of nubs 52 and 53 aligns with the terminal end of locking levers 35 and 36 when slide plate 3 is almost, but not completely inserted into lock compartments as is shown in FIGS. 3 and 5.

Slide plate 3 further has molded in grooves 60 in each of the side walls 41 and 42 which are correspondingly alignable with planar stops 31 so as to force slide plate 3 under stops 31 and prevent slide plate 3 from being removed from lock compartment 5 by a lifting action such as prying that would increase the distance between back wall 11 and front wall 40. Within grooves or cut-outs 60 are slightly raised surfaces 61 that frictionally fit within planar stops 31. Slide plate 3 further includes a locking tab 62 extending outward from the end of each divider wall 44 and 45 opposed bottom wall 43 where each locking tab 62 is spaced apart from front wall 40 so as to define a slot therebetween. Similar to the function of grooves 60, locking tab 62 engages L-shaped stop 32 thereby prohibiting separation of slide plate 3 by lifting or prying when the distance between back wall 11 and front wall 40 is increased.

In operation, security package 1 provides a reusable security device for preventing unauthorized removal of an article such as a compact disc in a jewel case from a store. Specifically, an article 15 such as a compact disc within a jewel case is inserted into storage compartment 4 by sliding one end of article 15 against end wall 8 so that the article receives tabs 20 and 21 therein, or alternatively slides under tabs 20 and 21. Once article 15 is substantially adjacent end wall 8, article 15 drops completely within storage compartment 4 which is substantially identically sized. At this time, article 15 may be locked within security package 1.

Figure 2:
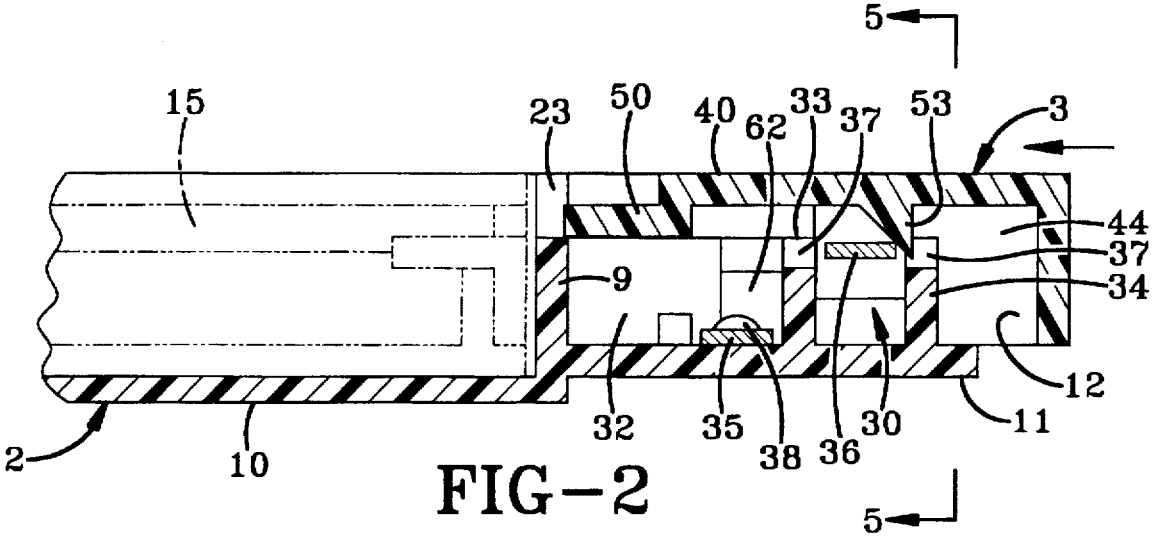
FIG. 2 is an enlarged fragmentary longitudinal section view taken on line 2—2 in FIG. 1 with the slide plate attached to the main housing and in the unlocked position.
Figure 4:
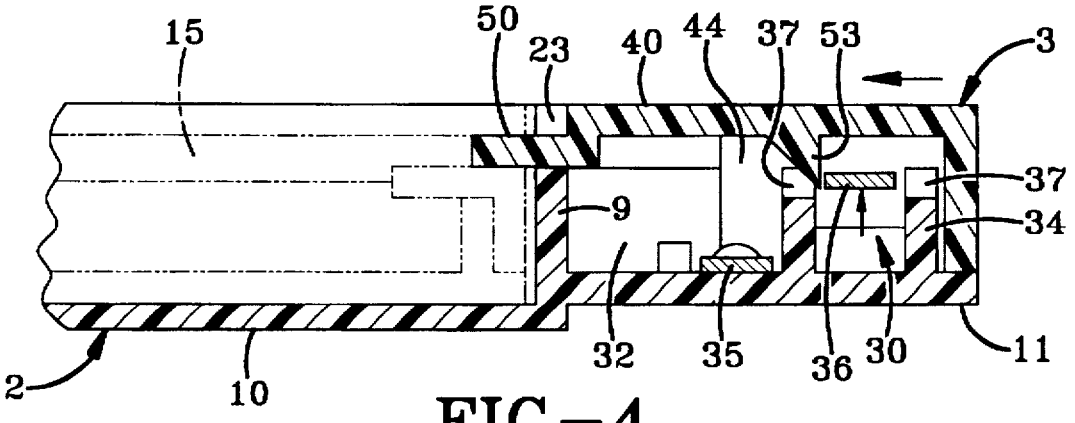
FIG. 4 is an enlarged longitudinal sectional view similar to FIGS. 2 and 3 with the slide plate fully inserted and locked into the housing.

This locking procedure occurs by aligning slide plate 3 with lock compartment 5. Specifically, slide plate 3 is longitudinally aligned below lock compartment 5 as is shown in FIGS. 1 and 2 in section. Slide plate 3 is moved longitudinally inward where grooves 60 are aligned with planar stops 31, and locking tabs 62 are aligned with L-shaped stops 32. Further insertion causes groove 60 to slide partially under stop 31 and tab 62 to slip slightly into stop 32 whereby nubs 52 and 53 pass through cut-outs 37 in walls 33 and 34. Such insertion eventually meets a slight resistance as each nub 52 and 53 interacts with and engages the termination end of locking levers 35 and 36 as is shown in FIG. 3. Continued insertion results in slight downward bending of locking levers 35 and 36 away from front wall 40 as is shown by the arrows in FIG. 3. Eventually, nubs 52 and 53 ride over locking levers 35 and 36 thereby allowing locking levers 35 and 36 to rebound or snap back to their original position and rest behind nubs 52 and 53 as is shown in FIG. 4. Once this has occurred, slide plate 3 is no longer removable from lock compartment 5 and housing 2. The result is the insertion of tabs 50 and 51 through notches 23 and 24 and into storage compartment 4 thereby blocking removal of article 15 from within storage compartment 4 by engaging article 15 similar to engagement by tabs 20–21 at the other end of the article. At this time, grooves 60 are fully inserted under stops 31, and locking tabs 62 on divider walls 44 and 45 are inserted under L-shaped stops 32 such that slide plate 3 is not removable by increasing the distance between slide plate 3 and back wall 11. Thus walls **7*a*, 7*b* and 11 on the housing 2 and walls 40, 41 and 42 on the slide plate form a tight box deplete of lips or other areas for prying package 1** apart.

Figure 6:
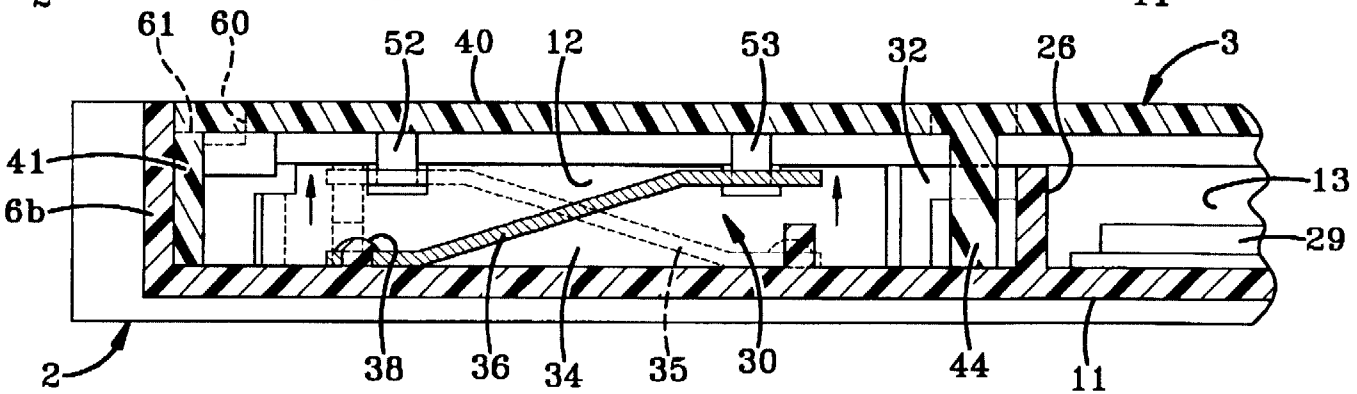
FIG. 6 is a transverse sectional view similar to FIG. 5 when the slide plate is fully inserted and locked into the housing as shown in FIG. 4.

This locking where the nubs 52 and 53 ride over locking levers 35 and 36 is clearly shown in FIGS. 5 and 6. In FIG. 5 the nubs 52 and 53 are bending each of the locking levers 35 and 36 downward. In contrast, in FIG. 6 the nubs have already passed the locking levers 35 and 36 and thereby allowed their return to their standard position which blocks removal of slide plate 3.

Figure 7:
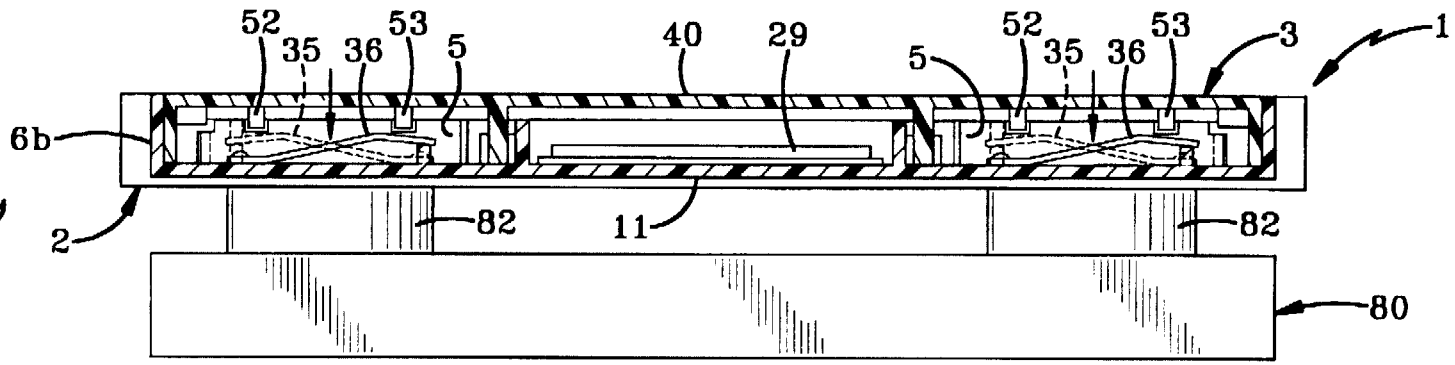
FIG. 7 is a transverse sectional view similar to FIG. 5 showing a magnetic key unlocking the security package.

When it is desirable to remove article 15 from security package 1, such as at point-of-sale, a magnetic key 80, such as is shown in FIG. 7, is used. Key 80 includes a plurality, in this case, two outwardly extending magnets or magnetic surfaces 82. Each of these magnets 82 is correspondingly positioned on key 80 so as to align with the general area in lock compartment 5 where levers 35 and 36 are located. In operation, magnets 82 are positioned adjacent to levers 35 and 36 along back wall 11 as is shown in FIG. 7. When the magnets 82 are sufficiently close, each lever 35 and 36 is magnetically attracted thereby bending or flexing away from the nubs 52 and 53 to a position such as shown in FIG. 7, thereby allowing housing 2 to be removed from slide plate 3. Once housing 2 is removed from slide plate 3, tabs 50 and 51 no longer block article 15 from being removed from storage compartment 4 via the access opening. Security package 1 is then reusable on another article as desired.

If desired, security package 1 may use a top wall or flange extending between walls **6*a* and 7*a* adjacent wall 8 replacing tabs 20 and 21, and a front edge of slide plate 3 could extend over a portion of storage compartment 4 to secure article 15 therein replacing tabs 50 and 51** as shown in the drawings and described above without effecting the concept of the invention.

Figure 8:
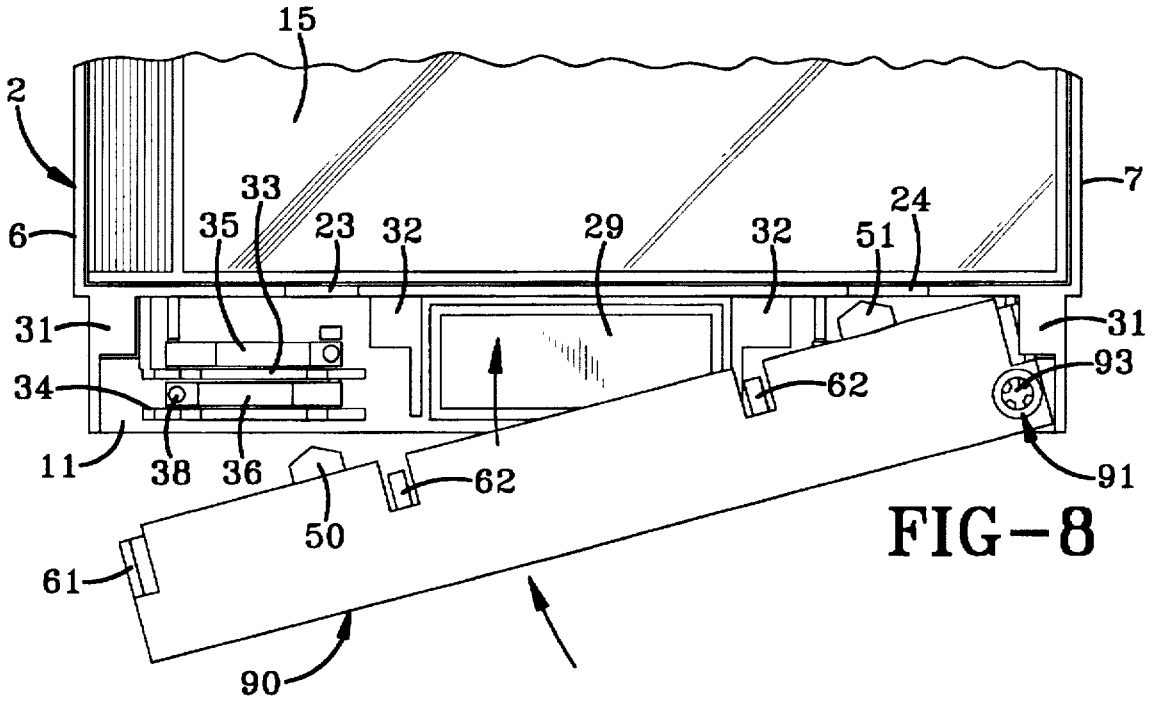
FIG. 8 is a fragmentary top plan view showing a modified embodiment of the present invention in which the lock plate is pivotally mounted on the housing and is shown in partial open position.
Figure 9:
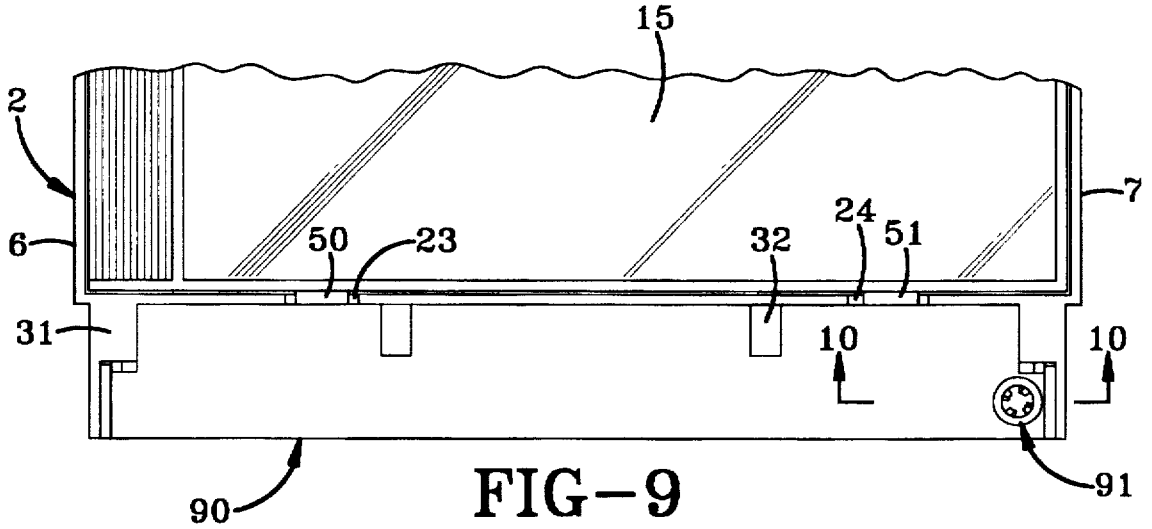
FIG. 9 is a fragmentary top plan view similar to FIG. 8 showing the lock plate in locked position.
Figure 10:
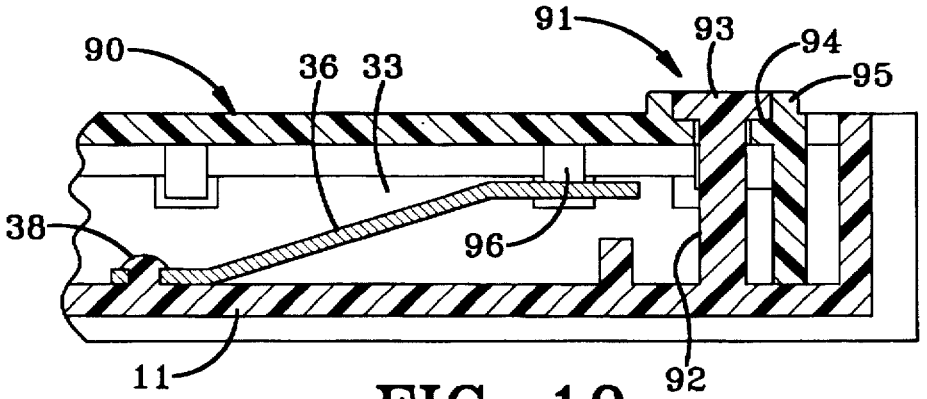
FIG. 10 is an enlarged fragmentary sectional view taken on line 10—10, FIG. 9.

A modified embodiment of the security package is shown in FIGS. 8–10 and is similar to package I in most details with the main difference being that a lock plate 90 is pivotally mounted with respect to lock compartment 5 by a pivot mechanism indicated generally at 91. Pivot mechanism 91 includes a pivot post 92 which preferably is molded integrally with wall 11 and extends upwardly therefrom and terminates in a pivot cap 93 which is snapped fitted within a complementary-shaped annular recess 94 formed in plate 90 by an annular boss 95.

As shown in FIGS. 8 and 9, the operation of the modified lock plate 90 is similar to that described above with respect to slide locking plate 3 except it is pivotally moved into a locking position as shown in FIG. 9, wherein the metallic resilient locking levers 35 and 36 engage nubs 96 which are formed on and extend downwardly from the bottom surface of plate 90, for securing lock plate 90 in the locked position until the locking levers are deflected to an unlocked position by the unlocking magnets as shown in FIG. 7.

Accordingly, the improved security package is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved security package is constructed and used, the characteristics of the construction, and the advantageous, new and useful results obtained; the new and useful structures, devices, elements, arrangements, parts and combinations, are set forth in the appended claims.

We claim:

1. A security package for holding and displaying a rectangular-shaped article comprising:

a housing having a rectangularly shaped storage compartment for selectively storing the article, said compartment having an access opening for inserting and removing the article into and out of said compartment;

a lock compartment formed adjacent the storage compartment;

a lock plate movably mountable with respect to the lock compartment and selectively movable across at least a portion of the access opening of the storage compartment between locked and unlocked positions, for releasably securing said article in said storage compartment; and magnetically releasable lock means within said lock compartment and operatively engageable with the lock plate for selectively securing the lock plate in the locked position and releasing the lock plate from said locked position when a magnetic field is proximate the magnetically releasable lock means.

2. The security package of claim 1 wherein the magnetically releasable lock means includes at least one deflectable tab.

3. The security package of claim 2 wherein said deflectable tab is a flexible, magnetically influenceable tab affixed within said lock compartment and biased away from the housing about its distal end.

4. The security package of claim 3 wherein said deflectable tab is obliquely affixed within said lock compartment.

5. The security package of claim 1 wherein the lock compartment includes a pair of spaced apart sets of deflectable tabs.

6. The security package of claim 5 further comprising an electronic surveillance tag affixed to at least one of the housing and the slide plate.

7. The security package of claim 2 further comprising lock receiving means.

8. The security package of claim 7 wherein the lock receiving means includes at least one ramp for blocking at least one deflectable tab during selective removal motion of said lock plate from said lock compartment.

9. The security package of claim 8 further comprising a magnetic key interactable with said deflectable tabs for releasing said deflectable tabs from engagement with said ramps.

10. The security package of claim 1 including pivot means for pivotally movably mounting the lock plate with respect to the lock compartment.

11. The security package of claim I wherein said lock compartment and lock plate when in said locked position form a substantially closed environment.

12. A security package for holding and displaying a jewel case which selectively holds and displays a compact disc comprising:

a base having a storage compartment formed by a pair of spaced apart parallel end walls, a pair of spaced apart parallel side walls and a bottom wall, and having an access opening opposite of the bottom wall for placing and removing said jewel case into and from said storage compartment where said compartment is sized and configured generally equal to that of the jewel case being contained therein;

a lock compartment formed adjacent to said storage compartment, said lock compartment formed by one of said end walls, a pair of spaced apart parallel side walls, and a bottom wall;

a lock plate slidably mountable on the lock compartment and selectively movable across at least a portion of the access opening of the storage compartment between locked and unlocked positions, for releasably securing said compact disc in said storage compartment, and said lock plate including at least one lock plate movement inhibitor; and a pair of spaced apart magnetically releasable locking mechanisms within said lock compartment, each of said magnetically releasable locking mechanisms for releasing the lock plate from the locked position by magnetically unlocking the locking mechanism from said lock plate movement inhibitor.

13. The storage package of claim 12 wherein each magnetically releasable locking mechanism includes at least one magnetically deflectable tab.

14. The security package of claim 13 wherein said magnetically deflectable tab is a flexible tab obliquely affixed within said lock compartment.

15. The security package of claim 12 wherein the slide plate includes at least one compact disc securing tab for blocking removal of said compact disc from said storage compartment when the lock plate is in the lock position.

16. The security package of claim 12 further comprising an electronic surveillance tag affixed to at least one of the housing and the lock plate.

17. The security package of claim 12 wherein the lock plate movement inhibitor includes at least one ramp for blocking at least one deflectable tab during selective removal motion of said lock plate from said lock compartment.

18. The security package of claim 12 wherein each releasable locking mechanism includes a pair of metallic strips extending parallel to each other.

19. The security package described in claim 18 wherein the strips of each pair of metallic strips are secured at a fixed end within the lock compartment and extend obliquely toward the slide plate in opposite angular directions.

20. A security system for selectively holding and displaying a jewel case with a compact disc therein comprising:

a security package having a housing formed with a rectangularly shaped storage compartment for selectively storing the jewel case, said jewel case being formed with at least one aperture in a wall thereof and the compartment having an access opening for inserting and removing the jewel case into and out of said compartment;

a lock compartment formed adjacent the storage compartment;

a lock plate movably mountable with respect to the lock compartment and selectively movable between locked and unlocked positions;

magnetically releasable lock means within said lock compartment and operatively engageable with the lock plate for selectively securing the lock plate in the locked position and for releasing the lock plate from said locked position when a magnetic field is proximate the magnetically releasable lock means; and at least one tab formed on the lock plate and selectively movable into the jewel case aperture when the lock plate is in the locked position for retaining said jewel case in the storage compartment.

* * * * *